US007326120B2

(12) United States Patent
Bellows et al.

(10) Patent No.: US 7,326,120 B2
(45) Date of Patent: Feb. 5, 2008

(54) SWING ASSEMBLY

(75) Inventors: William B. Bellows, Wyomissing, PA (US); Nicholas E. Papageorge, Upper Darby, PA (US)

(73) Assignee: Graco Children's Products Inc., Exton, PA (US)

( * ) Notice: Subject to any disclaimer, the term of this patent is extended or adjusted under 35 U.S.C. 154(b) by 171 days.

(21) Appl. No.: 11/079,513

(22) Filed: Mar. 15, 2005

(65) Prior Publication Data

US 2006/0252564 A1 Nov. 9, 2006

(51) Int. Cl.
*A63G 9/12* (2006.01)

(52) U.S. Cl. ..... 472/119

(58) Field of Classification Search ..... 472/118–125; 297/273

See application file for complete search history.

(56) References Cited

U.S. PATENT DOCUMENTS 4,805,902 A * 2/1989 Casagrande ..... 472/119
4,822,033 A * 4/1989 Kohus et al. ..... 472/119
5,562,548 A * 10/1996 Pinch et al. ..... 472/119
5,803,817 A 9/1998 Stern
5,846,136 A * 12/1998 Wu ..... 472/119
6,027,409 A 2/2000 Favorito et al.
6,386,986 B1 * 5/2002 Sonner et al. ..... 472/119
6,645,080 B1 11/2003 Greger et al.
6,877,802 B2 4/2005 Christensen et al.
7,189,164 B1 * 3/2007 Paesang et al. ..... 472/118
2004/0198512 A1 10/2004 Ransil et al.
2005/0014569 A1 1/2005 Greger et al.

OTHER PUBLICATIONS

GRACO 1990 Product Catalog, Coverta-Cradle® III, 1990, pp. 1, 2, 6, and 24.
Fisher-Price Smart Stages™ 3-in-1 Rocker Swing Instruction Manual, 2004, pp. 1-32, Mattel, Inc.

* cited by examiner

*Primary Examiner*—Kien Nguyen
(74) *Attorney, Agent, or Firm*—Lempia Braidwood LLC

(57) ABSTRACT

A child swing includes a swing frame, at least one hanger arm rotatably coupled to the swing frame, and a bouncer seat assembly including a bouncer frame and a seat coupled to the bouncer frame. The bouncer seat assembly is adapted to be attached to and detached from the at least one hanger arm. When the bouncer seat assembly is coupled to the at least one hanger arm, the bouncer frame and the seat can undergo swinging movement with the at least one hanger arm relative to the swing frame. When the bouncer seat assembly is detached from the at least one hanger arm and placed on a surface, the bouncer frame allows the seat to undergo bouncing movement relative to the surface.

23 Claims, 12 Drawing Sheets

SWING ASSEMBLY

FIELD OF THE INVENTION

The invention relates to a swing assembly. More specifically, the invention relates to a swing assembly that includes a seat, such as a bouncer seat, that can be attached to and detached from a child swing frame.

BACKGROUND OF THE INVENTION

Various types of child bouncer seats are known in the art. Child bouncer seats include a support frame and a seat that fits onto the support frame. A child can bounce up and down on the support frame to provide the child with some amusement. Some bouncer seats also can vibrate or play music.

Various types of child swings also are known in the art, such as open top child swings and closed top child swings. Typically, child swings include a support frame, hanger arms pivotally attached to the support frame, and a seat attached to the hanger arms. Electrically powered drive mechanisms are utilized to supply energy to the swing to move the swing seat in a reciprocal motion back and forth.

Children need constant supervision and may fall asleep when placed in a swing. Most commercially available child swings are cumbersome and too large to be easily moved from room to room. To avoid leaving a child unattended in the swing, a caregiver must either remain in one location with the swing or must remove the child from the swing and carry the child as the caregiver moves from one location to another. If the child has fallen asleep in the swing, removing child may awake the child and cause the child to cry.

Child swings have been developed that include detachable swing seats so that a parent can transport a sleeping child in the swing seat to a different location without disturbing the child. Once the swing seat is set on the ground or other stationary surface, however, the child generally wakes up due to the abrupt disruption of movement.

There is a need to provide a swing assembly that includes a detachable swing seat which can entertain and soothe a child in any location, on or off the swing frame.

SUMMARY OF THE INVENTION

An aspect of the present invention relates to a child swing. The child swing includes a swing frame, at least one hanger arm rotatably coupled to the swing frame, and a bouncer seat assembly including a bouncer frame and a seat coupled to the bouncer frame. The bouncer seat assembly is adapted to be attached to and detached from the at least one hanger arm. When the bouncer seat assembly is coupled to the at least one hanger arm, the bouncer frame and the seat can undergo swinging movement with the at least one hanger arm relative to the swing frame. When the bouncer seat assembly is detached from the at least one hanger arm and placed on a surface, the bouncer frame allows the seat to undergo bouncing movement relative to the surface.

Another aspect of the present invention relates to a child swing. The child swing includes a swing frame. The child swing includes at least one hanger arm moveably coupled to the swing frame, the at least one hanger arm including a mount having an arcuate surface. The child swing further includes a seat. The child swing also includes at least one attachment assembly associated with the seat and having a complementary arcuate surface, the at least one attachment assembly adapted to be coupled to the mount of the at least one hanger arm. The arcuate surface and the complementary arcuate surface are adapted to move relative to each other to allow the seat to recline relative to the at least one hanger arm.

Yet another aspect of the present invention relates to a child swing. The child swing includes a swing frame and first and second hanger arms moveably coupled to the swing frame, each of the first and second hanger arms including a mount. The child swing also includes a seat adapted to be attached to or detached from the respective mounts of the first and second hanger arms. The first and second hanger arms are separate from one another on the child swing.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION

Figure 1:
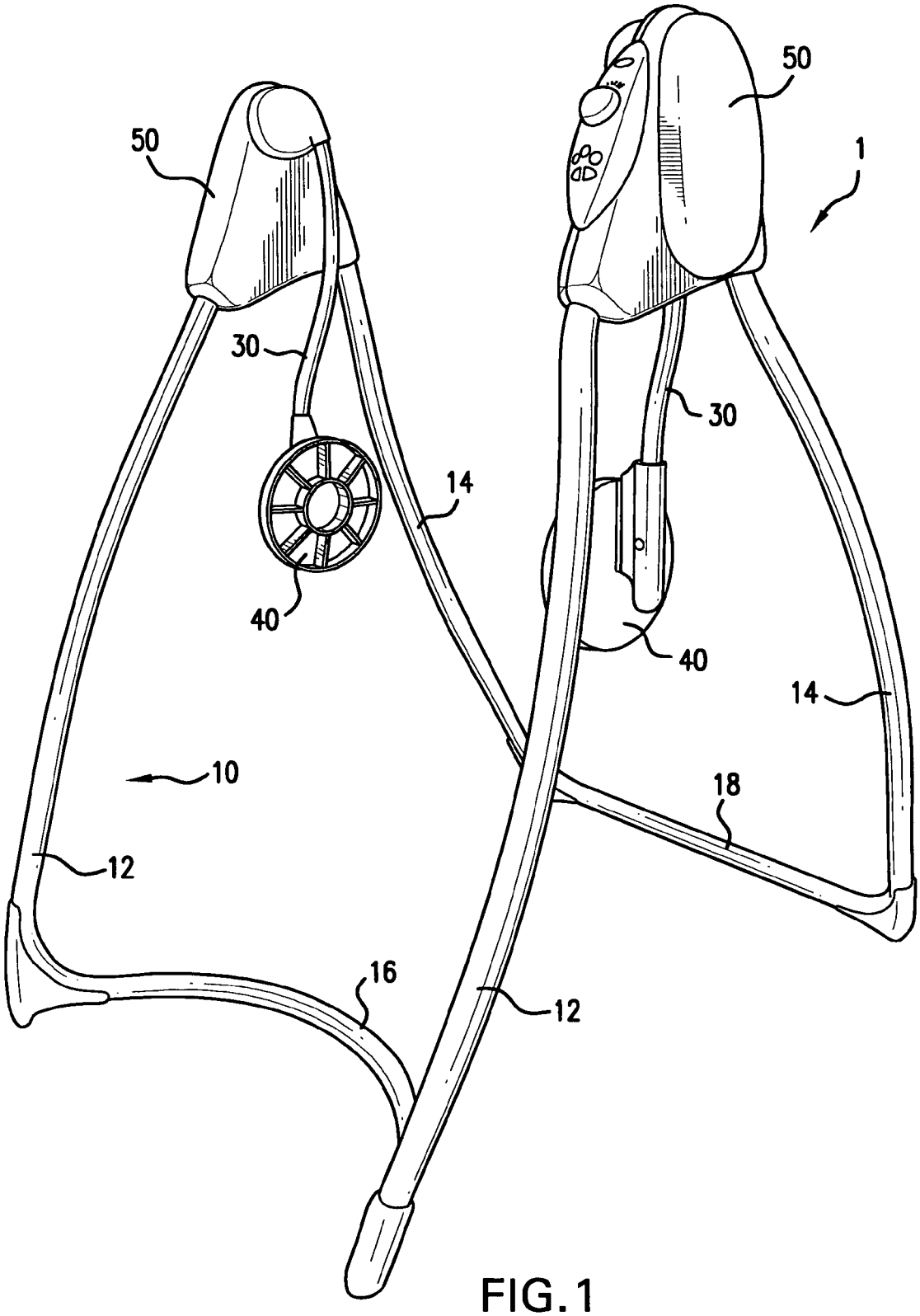
FIG. 1 is a perspective view of an embodiment of a swing frame and hanger arms according to the invention.

Reference will now be made in detail to embodiments of the invention, examples of which are illustrated in the accompanying drawings. An effort has been made to use the same reference numbers throughout the drawings to refer to the same or like parts.

FIG. 14 illustrate different views of a swing 1 according to an embodiment of the present invention. The swing 1 includes a swing frame 10. The swing 1 also includes at least one hanger arm 30 rotatably coupled to the swing frame 10. The swing frame 10 supports the hanger arms 30 so that a bouncer seat assembly 22 can be suspended from the swing frame 10. The bouncer seat assembly 22 includes a seat 20 and a bouncer frame 77. The bouncer seat assembly 22 is adapted to be attached to and detached from the hanger arms 30. When the bouncer seat assembly 22 is attached to the hanger arms 30, the bouncer seat assembly 22 can undergo swinging movement with the hanger arms 30 relative to the swing frame 10. When the bouncer seat assembly 22 is detached from the hanger arms 30 and placed on a surface, the bouncer frame 77 allows the seat 20 to undergo bouncing movement relative to the surface. When a caregiver has to leave an area where the swing 1 is located, the caregiver can remove the bouncer seat assembly 22 from the swing 1, carry the bouncer seat assembly 22 with child to a new location, and place the bouncer seat assembly 22 on a support surface, such as a floor. The child, who previously had been entertained and soothed by the swinging motion of the swing 1, now can be entertained and soothed by the bouncing motion of the bouncer seat assembly 22.

In electric swings, the swing 1 can include a motor mechanism and a power supply for supplying power to the motor mechanism to drive swinging motion of the seat 20. The motor mechanism and the power supply can be disposed within a frame housing 50. The power supply may be, for example, a battery pack.

The swing frame 10 generally includes first and second front legs 12, first and second rear legs 14, frame housings 50 to which the front and rear legs 12, 14 are coupled, a front cross member 16 extending between the front legs 12, and a rear cross member 18 extending between the rear legs 14. In other embodiments, the swing frame 10 can include first and second front legs only or first and second rear legs only. Other swing frame embodiments, such as those with different-shaped legs, various fold configurations, and different sizes (full, compact, travel) are contemplated by the invention.

As shown in FIG. 1, the area between uppermost portions of the swing frame 10 is open so that a child can easily be installed in or removed from the seat 20 by a caregiver. The bouncer seat assembly 22 of the child swing 1 can be removed from the hanger arms 30, without the use of tools or disassembly of the swing frame 10. When the bouncer seat assembly 22 is removed from the hanger arms 30, an area between the innermost components of the hanger arms 30 is open and unobstructed. For example, the area between the mounts 40 is open and unobstructed. The open top style of the swing 1 enables the user to install the child in the seat 20, or remove the child from the seat 20, when the seat 20 is suspended from the swing frame 10. The seat 20 can be removed from a closed top swing with slightly more difficulty, but still in a relatively straightforward manner.

The swing frame 10 optionally can be configured to fold. For example, the front legs 12 and the rear legs 14 can be assembled so as to pivot relative to each other within the respective frame housings 50, such as disclosed in U.S. Pat. No. 6,645,080, issued Nov. 11, 2003, and U.S. Publication No. 2004/0198512 A1, published Oct. 7, 2004, both of which are incorporated by reference herein in their entirety. A caregiver can fold the swing frame 10, for example, by moving the rear legs 14 toward the front legs 12.

The hanger arms 30 are positioned to engage the swing frame 10 via the frame housings 50 as described above, so that the bouncer seat assembly 22 is suspended from the swing frame 10 in a stable manner. In one embodiment, the hanger arms 30 can swing independently relative to the swing frame 10. For example, one hanger arm 30 can be driven by the motor mechanism, while the other hanger arm 30 is not. When a caregiver activates the motor mechanism, motion can be transmitted through one of the frame housings 50 (the one housing the motor mechanism) to one of the hanger arms 30, a 'lead' hanger arm. The non-motor-controlled hanger arm 30, a 'follower' hanger arm, joined to the lead hanger arm by the presence of the bouncer frame assembly 22 on the hanger arms 30, can follow the motion of the lead hanger arm 30. The bouncer seat assembly 22 can thus swing back and forth on the swing frame 10 in a forward direction and a rearward direction.

Figure 4:
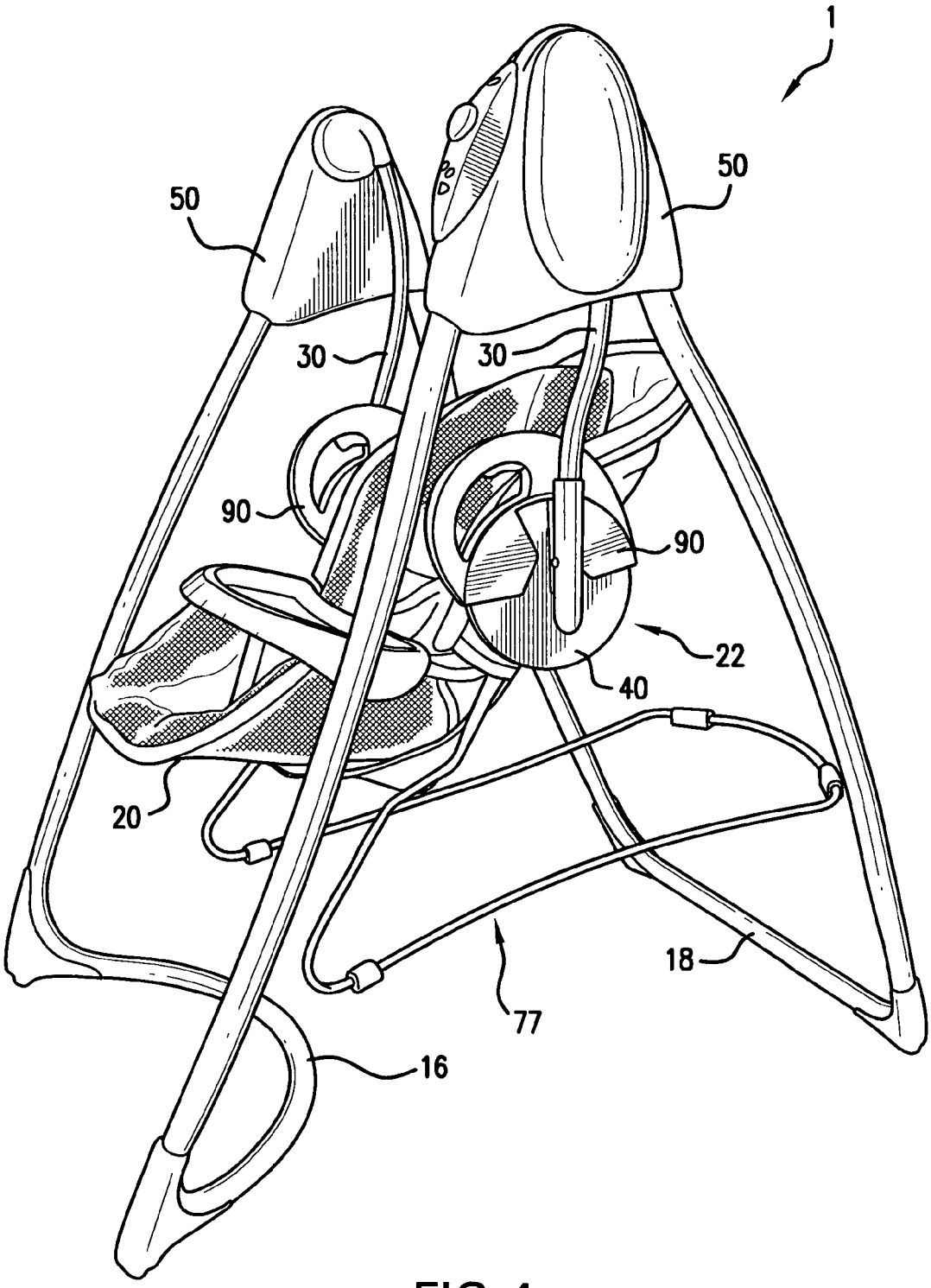
FIG. 4 is a perspective view of an embodiment of a swing according to the invention.
Figure 7:
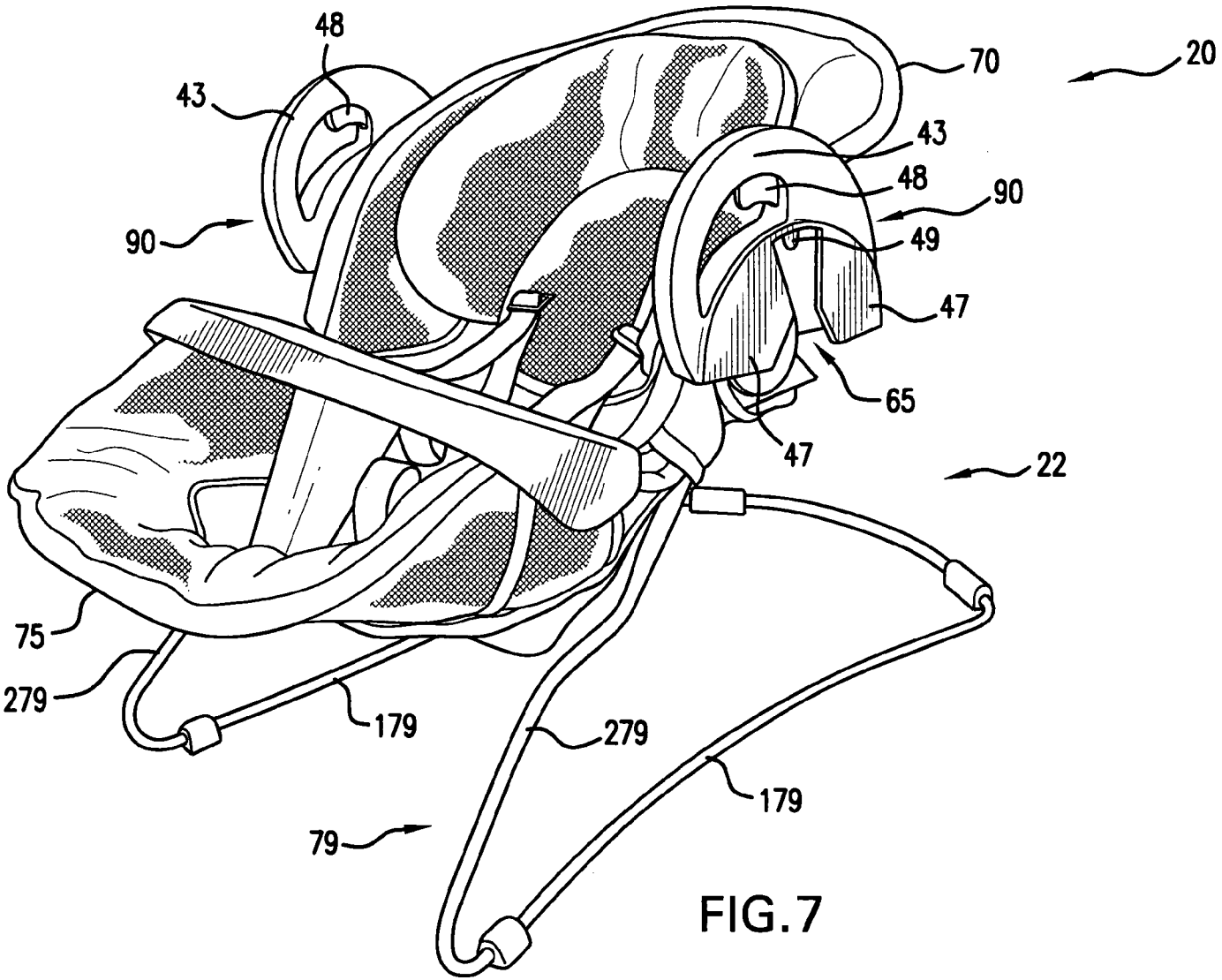
FIG. 7 is a perspective view of a seat and bouncer frame assembly according to the invention.
Figure 8:
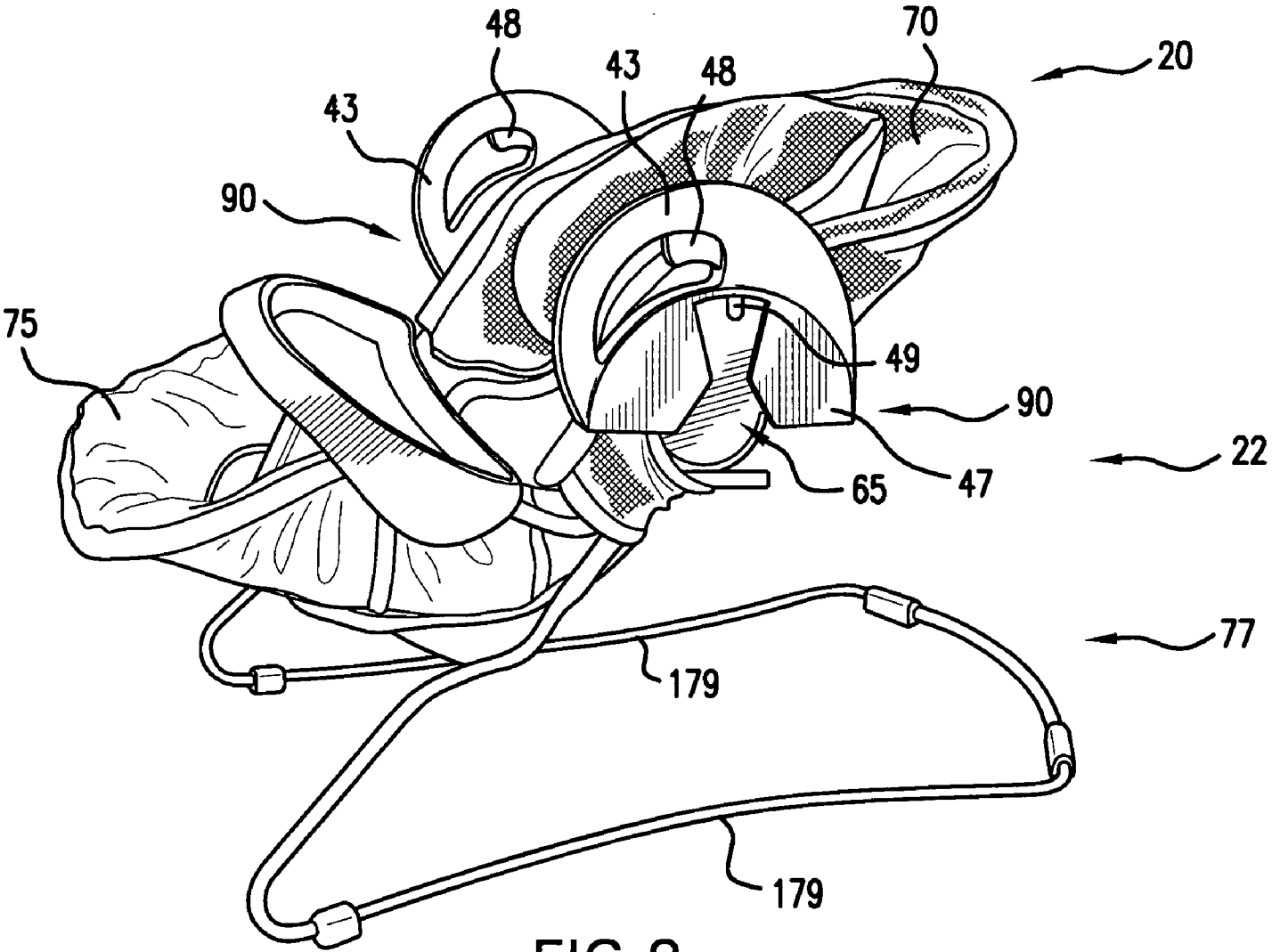
FIG. 8 is a side perspective view of the seat and bouncer frame assembly.
Figure 9:
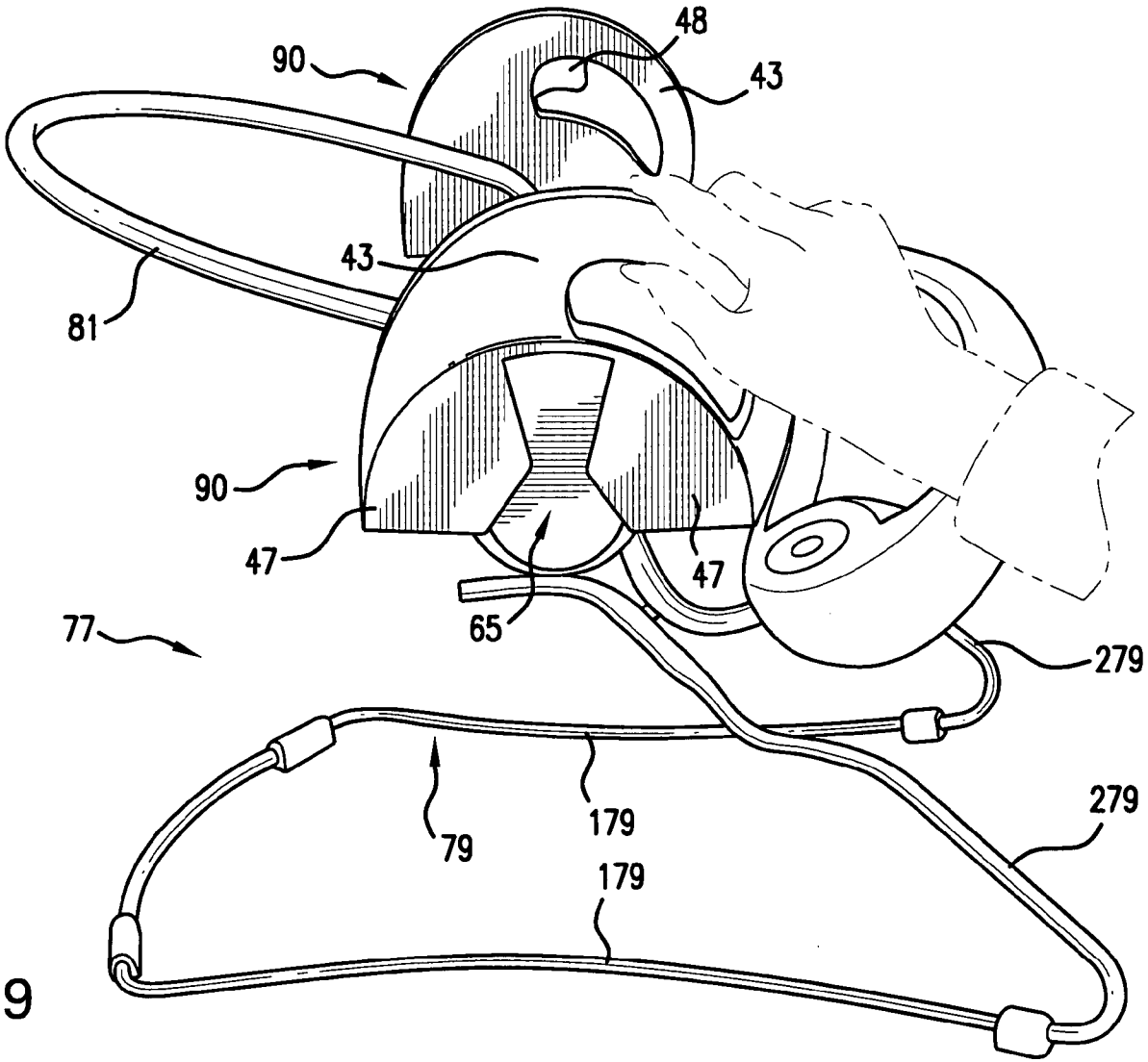
FIG. 9 is a side elevation view of the bouncer frame.

As mentioned above, the bouncer seat assembly 22 is suspended from the swing frame 10 by the hanger arms 30, as seen in FIG. 4. FIGS. 7 and 8 show different views of the bouncer seat assembly 22 that can be coupled to the swing 1 in accordance with one embodiment of the invention. FIG. 9 shows the bouncer seat assembly 22 without the seat 20, in which only the bouncer frame 77 is shown. The bouncer frame 77 can be formed by a wire frame, a plastic tubular frame, non-tubular plastic frame members, or other suitable frame members.

The bouncer frame 77 supports soft goods in the form of the seat 20. As shown in FIGS. 7 and 8, the seat 20 includes a seat back 70 and a seat bottom 75 so that the child can be comfortably positioned in the seat 20. The bouncer frame 77 coupled to the seat 20 is configured to support the seat 20 when the seat 20 is detached from the swing frame 10 and placed on a support surface, such as a floor or a table.

As shown in FIG. 9, the bouncer frame 77 includes a base frame 79 and a seat support frame 81. The base frame 79 can include left and right side base frame members 179, which can rest on the support surface, and left and right side arm members 279, which extend upwardly from the base frame members 179 toward the seat support frame 81. The left and right side base frame members 179 can curve inwards towards each other at an intermediate section along their respective lengths. The base frame 79 thus can be wider in the front and the back than in the middle, to provide a stable frame for the seat 20 that it supports. The curved nature of the base frame 79 allows a caregiver to easily attach the bouncer seat assembly 22 onto the swing 1 and detach it from the swing 1; the curved base frame members 179 provide clearance for the hanger arms 30, frame housings 50, and other portions of the swing frame 10 during the attachment/detachment process.

The bouncer frame 77 also includes attachment assemblies 90, which are coupled to the seat support frame 81. In an alternative configuration, the attachment assemblies 90 can be coupled to the base frame 79. The attachment assemblies 90 can be screwed in place or bolted in place on the bouncer frame 77. The attachment assemblies 90 can releasably attach to the hanger arms 30 of the swing 1, which will be explained in more detail below.

The hanger arms 30 each include a hanger mount 40. The hanger mounts 40 are configured to attach to the attachment assemblies 90 of the bouncer seat assembly 22, so that the seat 20 can be suspended from the swing frame 10.

Figure 2:
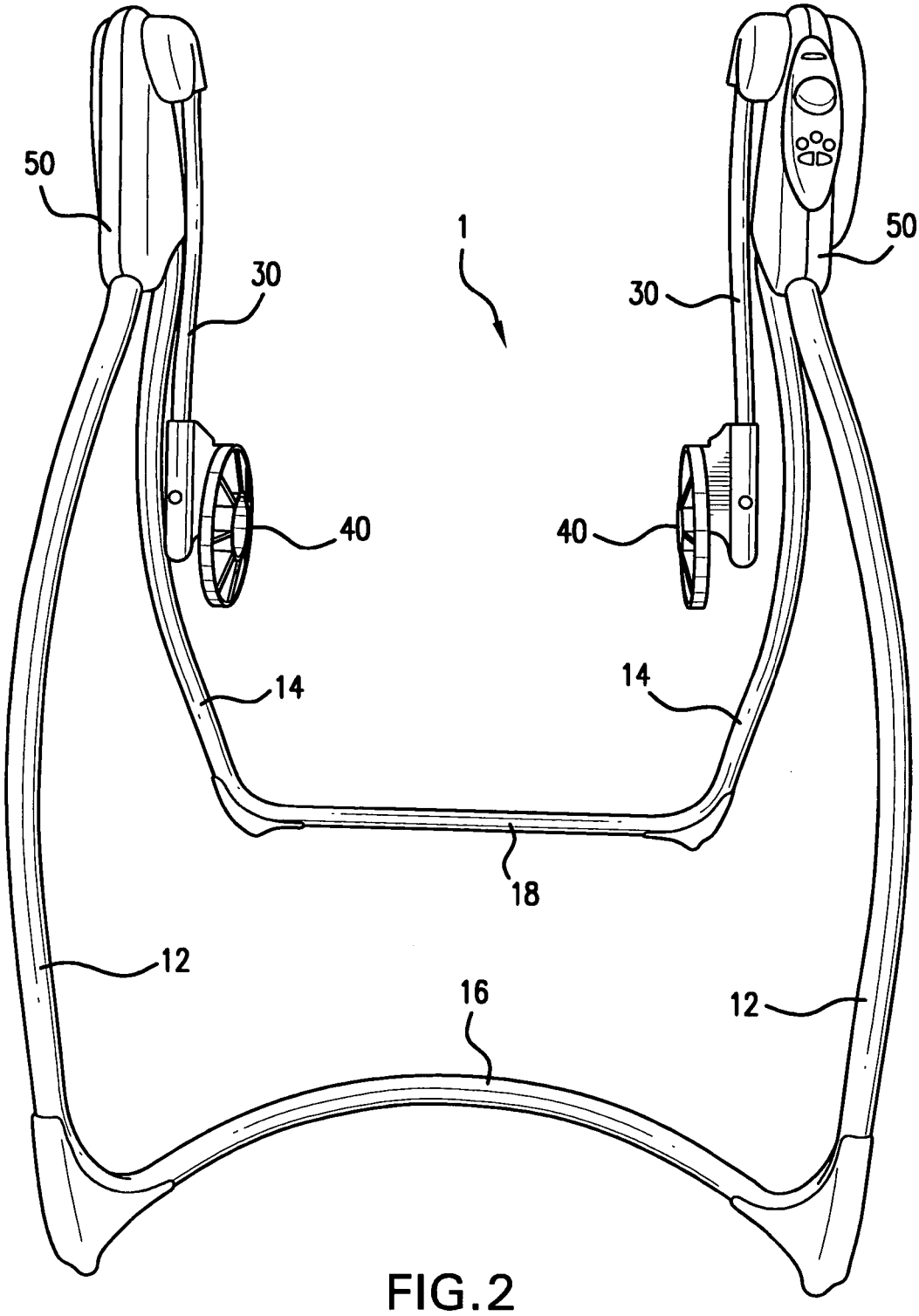
FIG. 2 is a front view of the swing frame and hanger arms.
Figure 3:
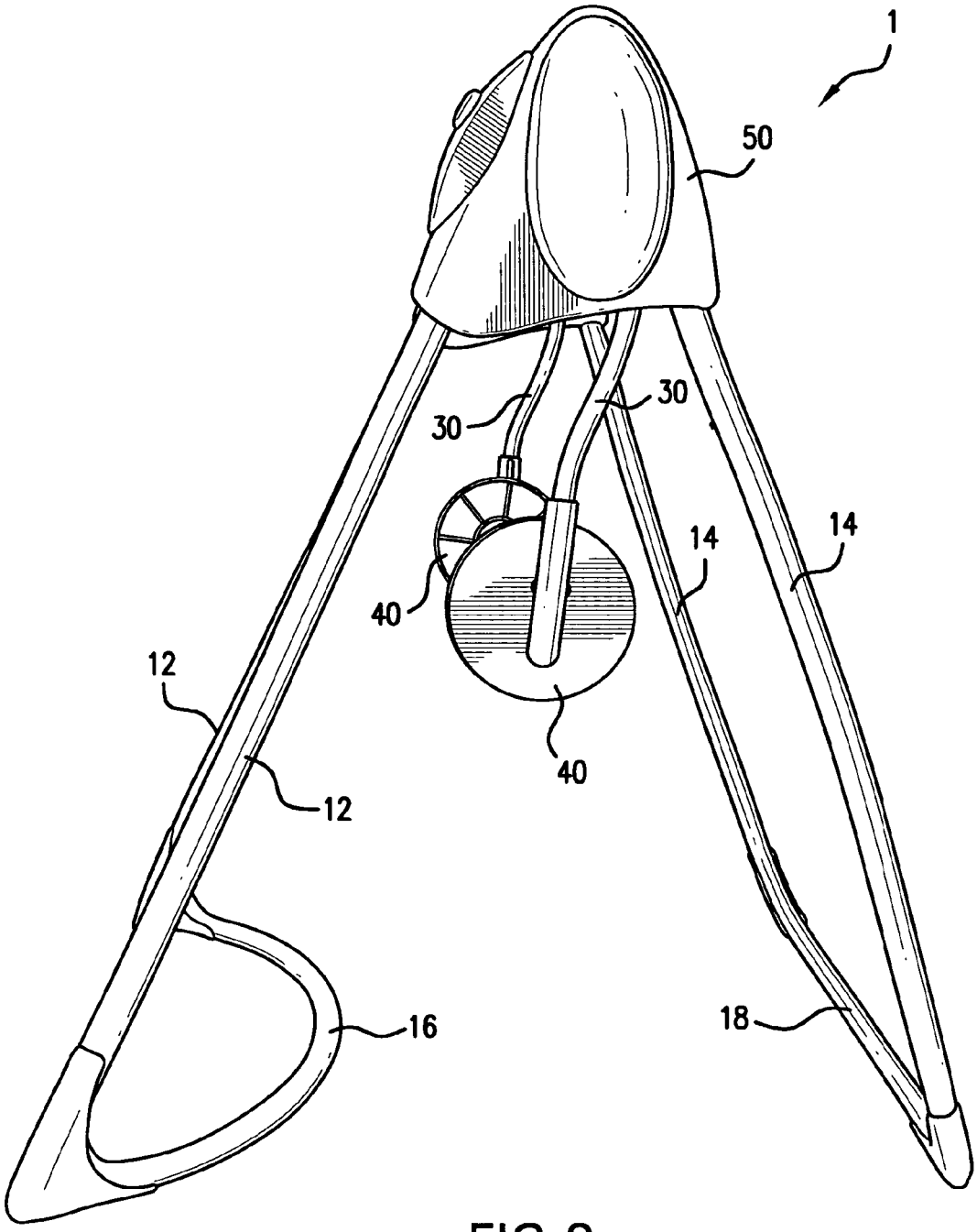
FIG. 3 is a side elevation view of the swing frame and hanger arms.

In a first embodiment, the mounts 40 preferably have an arcuate shape (they can be circular shaped or disk shaped) and are located at an end portion of the hanger arms 30, as shown in FIGS. 1-3. Alternatively, the mounts 40 can be located elsewhere, such as at a half-way position or at a three-quarters position, on the hanger arms 30. Each mount 40 is configured to receive a respective attachment assembly 90 of the bouncer seat assembly 22, to allow the bouncer seat assembly 22 to be readily coupled to and decoupled from the swing 1. The arcuate-shaped mounts 40 provide an easy to align, self-centering landing location for the bouncer seat assembly 22, when the bouncer seat assembly 22 is coupled to the swing 1.

Figure 5:
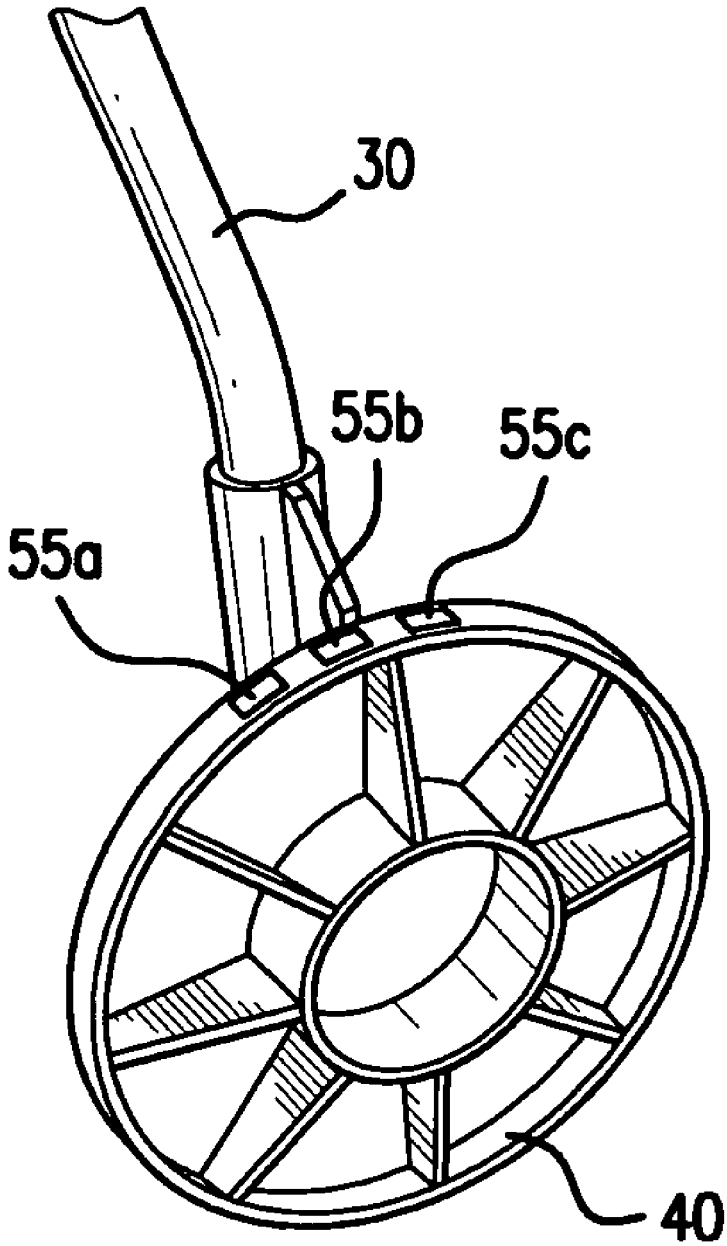
FIG. 5 is a perspective detail view of a hanger arm, including a mount, of the swing.
Figure 6:
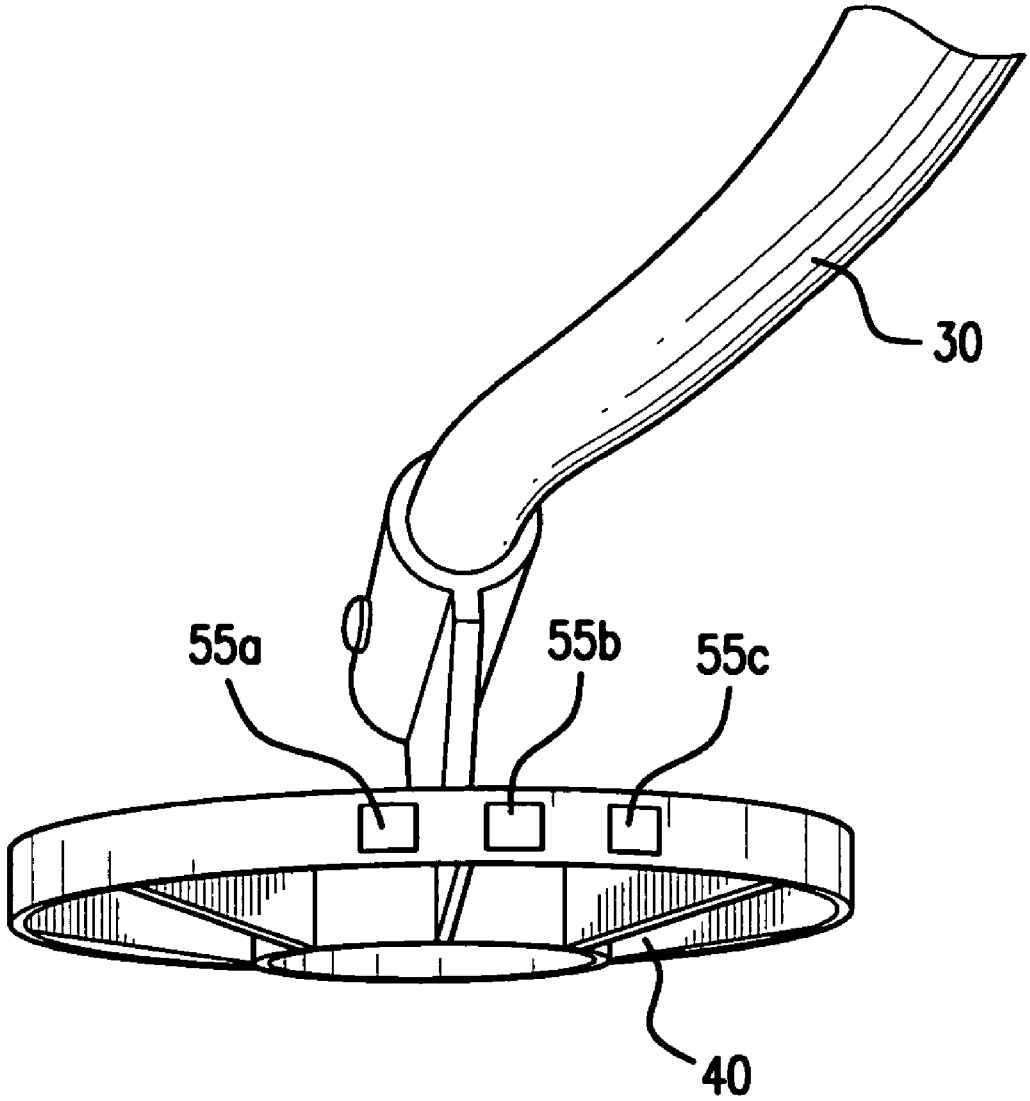
FIG. 6 is a top perspective view of a hanger arm, including the mount, of the swing.

Referring now to FIGS. 5 and 6, at least one of the mounts 40 has at least one slot provided thereon. The at least one slot can be provided on a top surface of the mount 40. Preferably, there are three slots provided on the mount 40. A first slot 55*a* corresponds to an recline position of the bouncer seat assembly 22 when attached to the swing 1, a second slot 55*b* corresponds to an intermediate position of the bouncer seat assembly 22 when attached to the swing 1, and a third slot 55*c* corresponds to an incline position of the bouncer seat assembly 22 when attached to the swing 1. Each slot 55*a*, 55*b*, 55*c* is sized to accommodate a coupling mechanism of an attachment assembly 90, such as a tab, as will be described in more detail below.

FIGS. 7-9 show first and second attachment assemblies 90 fixedly attached to first and second sides of the seat support frame 81. Each attachment assembly 90 preferably includes a hand grip housing 43, a mount attachment housing 47, a latch 48, and a tab (or coupling mechanism) 49. As shown in FIGS. 7 and 8, the tab 49 is normally in an extended position. A spring assembly (contained within hand grip housing 43) is coupled to the latch 48 and maintains the tab 49 in its extended position when the latch 48 is not actuated by a caregiver. When the latch 48 is actuated by the caregiver, as shown in FIG. 9, the tab 49 can move inwards towards a top (curved) surface of the mount attachment housing 47, and the tab 49 is hidden from view. When the bouncer seat assembly 22 is to be attached to the swing 1, the caregiver can place the first and second attachments arms 90 over the respective mounts 40 of the hanger arms 30 and can position the mount attachment housings 47 on the mounts 40 so that the tabs 49 can engage a desired slot 55*a*, 55*b*, 55*c* on the mounts 40.

The caregiver can select an appropriate recline position for the bouncer seat assembly 22 (and therefore the seat 20) on the swing 1 by positioning the tabs 40 in one of the three slots 55*a*, 55*b*, 55*c* corresponding to that recline position on each mount 40. When the tab 49 is fitted within one of the slots of the mount 40, the bouncer seat assembly 22 is held in place at a predetermined recline angle on the swing 1.

Figure 11B:
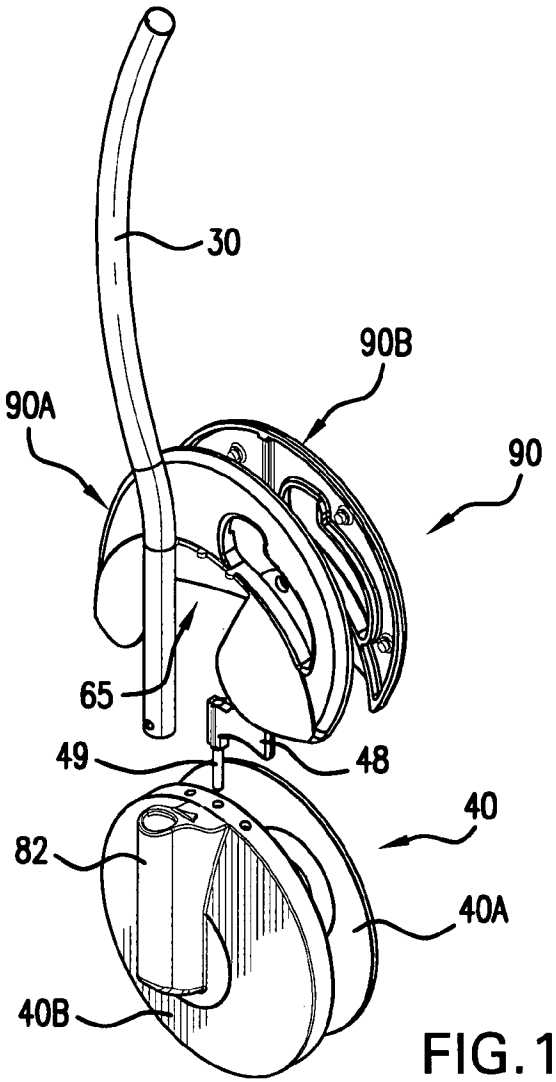
FIGS. 11A and 11B are exploded front and perspective views of the hanger arm/mount assembly and the attachment assembly.
Figure 11A:
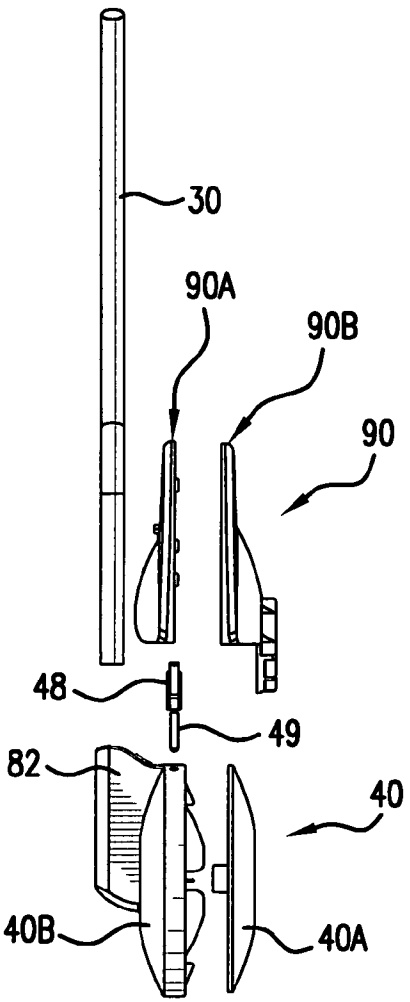
Figure 12:
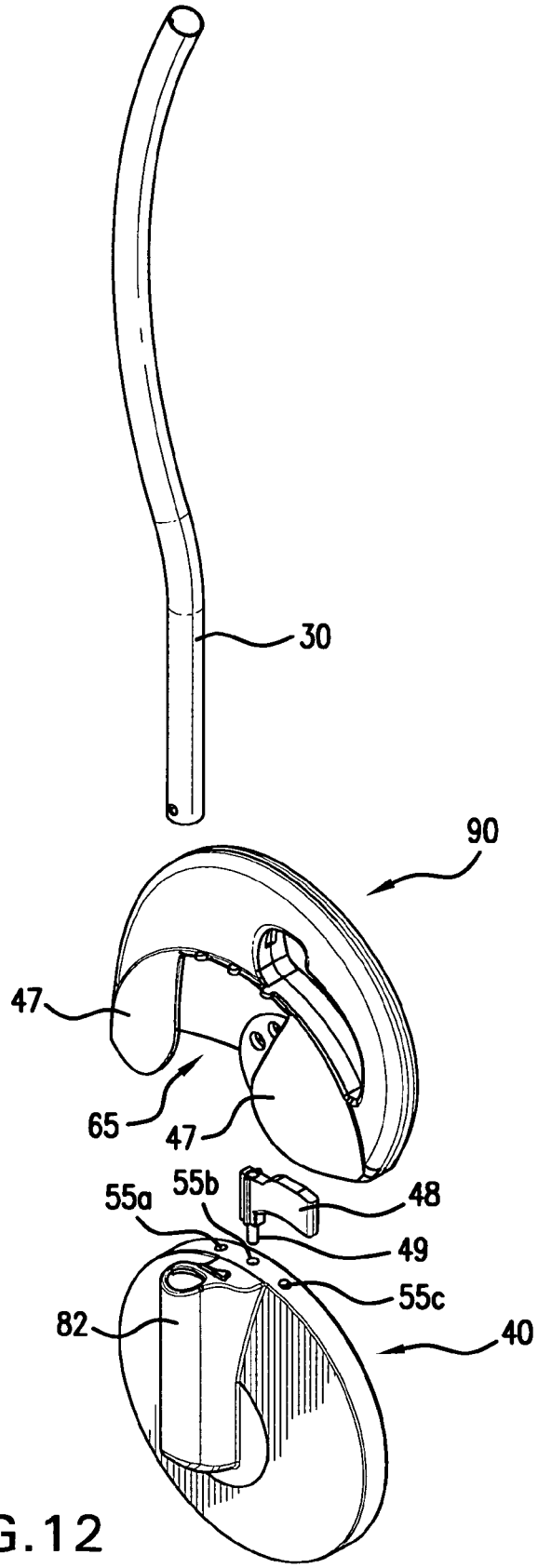
FIG. 12 is an exploded perspective view of the hanger arm/mount assembly and the attachment assembly.

The mounts 40 of the swing 1 support the weight of the bouncer seat assembly 22 by their being in direct contact with, and being disposed beneath, the attachment assemblies 90 of the bouncer frame 77. In more detail, each of the first and second attachment assemblies 90 includes a half-circular shaped attachment housing 47, which has the same shape (or substantially the same shape) as the top half of the mount 40 to which it is to be coupled. The mounts 40 and the attachment housings 47 have arcuate surfaces that are complementary with each other. For example, each can have a convex shape, as seen in FIGS. 10-12; in alternative embodiments, each can have a concave shape, or each can have an oval shape. The arcuate surface of the mounts 40 and the complementary arcuate surface of the attachment housings 47 are adapted to move relative to each other to allow the seat 20 to smoothly change between recline angles relative to the hanger arms 30. In an alternative embodiment, the mounts 40 and the attachment housings 47 each can have a shape that is non-arcuate (e.g., trapezoidal, triangular, etc.), with the shape being the same for both of them. The mounts 40 and the attachment housings 47 can readily be coupled to each other and decoupled from each other due to their same or substantially same mating surfaces, and the bouncer seat assembly 22 can be moved to a desired recline position by a caregiver in a relatively easy manner.

Figures 10A, 10B, 10C:
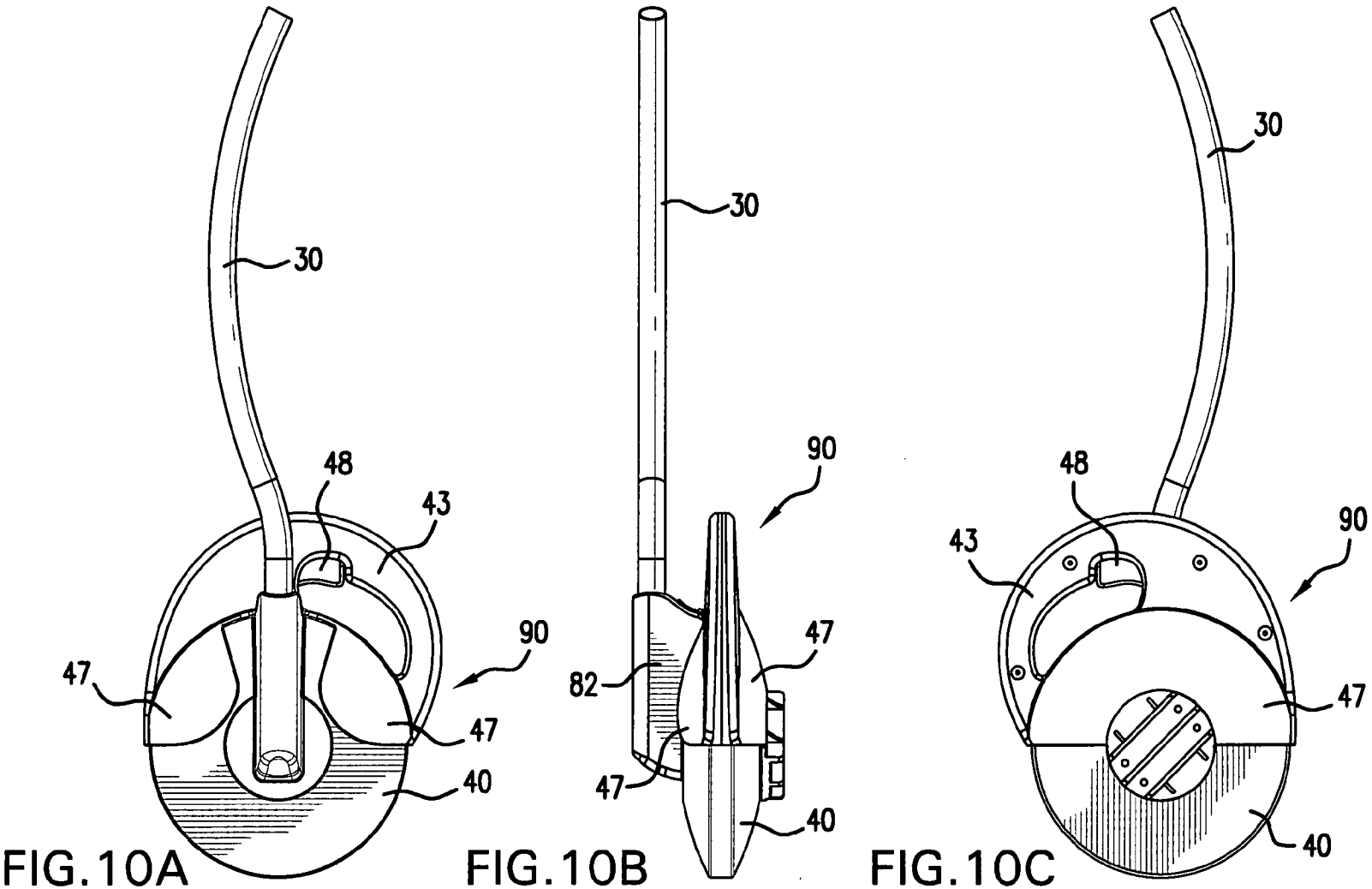
FIGS. 10A, 10B and 10C are detail outer side, front and inner side views of the hanger arm/mount assembly and an attachment assembly.

When a caregiver desires to attach the bouncer seat assembly 22 to the swing 1, the caregiver slides the first and second side attachment housings 47 over the respective mounts 40, allowing a post receiving portion 82 of the mounts 40, as shown in FIG. 10B, to pass through channels 65 provided on an outer sidewall of the attachment assemblies, as shown in FIG. 9. In particular, the caregiver positions the channels 65 of the left and right attachment housings 47 over the first and second mounts 40, respectively, and then lowers the bouncer seat assembly 22 until the attachment housings 47 engage the top portion of the mounts 40. The caregiver need not actuate the latch 48 at this time; the tabs 49 of the first and second attachment assemblies 90 go simply into a desired one of the slots 55*a*, 55*b*, 55*c* on the respective mounts 40.

When the caregiver desires to remove the bouncer seat assembly 22 from the swing 1, and the tabs 49 of the attachment assemblies 90 are positioned in either of slots 55*a* or slots 55*c* of the mounts 40, the caregiver need only actuate the latches 48, which lifts the tabs 49 from the slots, and, at the same time, lift the bouncer seat assembly 22 upwards to detach it from the mounts 40. When the tabs 49 are positioned within slots 55*b*, the caregiver does not need to actuate the latches 48 to lift the bouncer seat assembly 22 away from the mounts 40. The caregiver can then take the bouncer seat assembly 22, with child, to a new location, and place the bouncer seat assembly 22 on a support surface, such as a floor.

The coupling of a tab 49 into a slot of the mount 40 can provide a secondary locking mechanism for securing the bouncer seat assembly 22 to the swing 1. When the tab 49 is fitted into the middle slot 55*b* of the mount 40, which is provided at a 0 degree (top) position on the circular-shaped mount 40, the tab 49 fits directly into the slot 55*b*; no secondary locking feature exists for this coupling. However, when the tab 49 is fitted into either the recline slot 55*a* or the incline slot 55*c*, the tab 49 enters the slot 55*a* or 55*c* at a non-90 degree angle, and the tab 49 is held in place against a sidewall of the slot 55*a* or 55*c*. This non-orthogonal (angle different than 90 degrees) coupling of the tab 49 to the slot 55*a* or 55*c* provides for a secondary locking mechanism for the bouncer seat assembly 22. In order to unlock the tabs 49 of attachment assemblies 90 from slots 55*a* or slots 55*c* of the respective mounts 40, so as to change the recline position of the bouncer frame assembly 22 or to remove the bouncer seat assembly 22 from the swing frame 10, the caregiver can actuate the latches 48, and at the same time lift the bouncer seat assembly 22 off of the mounts 40 of the hanger arms 30.

In another embodiment, slots can be provided on a side surface of the mounts 40, instead of at the top surface of the mounts 40, and a tab can extend laterally from a sidewall of the respective attachment housings 47. In this embodiment, the tab-into-slot coupling provides for a secondary locking mechanism for holding the bouncer seat assembly 22 onto the swing 1. Because the tab-into-slot coupling extends transversely to the direction in which the bouncer seat assembly 22 is lifted off of the mounts 40, the latches 48 of the attachments arms 90 must be actuated to either change recline position or to remove the bouncer frame assembly 22 from the swing frame 20. For example, to remove the bouncer seat assembly 22 from the swing 1, the caregiver can actuate the latches 48 on the attachment assemblies 90, to cause the tabs to disengage from the slots of the mounts 40. With the latches 48 actuated, the caregiver then can lift the bouncer seat assembly 22 upwards to separate the mounts 40 from the respective attachment assemblies 90, and the caregiver can then place the bouncer seat assembly 22 on a support surface, such as a table or a floor.

The hanger arms 30, mounts 40, and the various attachment assembly components of the bouncer seat assembly 22 can be formed of various materials, such as metal or plastic.

When a caregiver has to leave an area nearby where a child is swinging on a swing 1, the caregiver can easily detach the bouncer seat assembly 22 from the swing 1, and carry the bouncer seat assembly 22 to any location the caregiver needs to go. Once the bouncer seat assembly 22 is detached from the swing frame 10, the bouncer frame 77 can be placed on a support surface, so that a child placed in the seat 20 can bounce up and down to entertain himself or herself. This will make it less likely that the child will be upset when removed from the swing frame 10.

FIGS. 10A-10C, 11A, 11B and 12 show the various components of the attachment assemblies 90 and the mounts 30. The attachment assembly 90 can include an outer side shell 90A and an inner side shell 90B, which are coupled together in a rigid manner (e.g., screwed together and/or glued together) to form a circular-shaped attachment assembly 90. The inner side shell 90B has as a semi-circular shape (see FIGS. 10C, 11B). The outer side shell 90A has a left side and a right side flap (see FIGS. 10A, 11B) with the channel 65 provided therebetween. The mount 40 comprises an inner side shell 40A and an outer side shell 40B, which are coupled together to form a circular-shaped mount 40. The mount 40 also includes a post receiving portion 82, as shown in FIG. 12, for receiving an end of the hanger arm 30, and by which the mount 40 is rigidly held in place on the hanger arm 30. The mount 40 can be screwed onto the hanger arm 30, as seen, for example, in FIGS. 1-3, in order to provide a very rigid coupling of these components.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. For example, for swings that have one hanger arm that extends downward from a central portion of a closed top swing, the attachment assemblies 90 of the bouncer seat assembly may be rigidly connected to a rear exterior shell of the child seat 20, in order to thereby be coupled to a mount of the centrally-positioned hanger arm. Furthermore, other locations for the attachment assemblies 90 besides what is shown and described herein may be contemplated (e.g., coupled to the base frame 79 of the bouncer frame 77). Also, other types of seats besides bouncer seats may be coupled to a swing frame using the attachment assemblies described hereinabove. For example, a jumper seat, a bassinet/sleeper seat, a changing table, or a purely stationary seat can be adapted to include attachment assemblies, so as to be attachable to a swing in accordance with at least one embodiment of the invention. Also, in an alternative construction, the attachment assembly for the seat (that attaches to the mounts of the swing) can be provided as part of the same mold that forms the child seat, thereby forming an integral child seat. Furthermore, in another configuration, the seat can be designed to detach freely from the swing frame at any recline position, in which case a latch is not needed in the attachment assembly. The spirit and scope of the invention are indicated by the following claims.

What is claimed is:

1. A child swing comprising:

a swing frame;

at least one hanger arm rotatably coupled to the swing frame; and a bouncer seat assembly including a bouncer frame and a seat coupled to the bouncer frame, wherein the bouncer seat assembly is adapted to be attached to and detached from the at least one hanger arm, wherein, when the bouncer seat assembly is coupled to the at least one hanger arm, the bouncer frame and the seat can undergo swinging movement with the at least one hanger arm relative to the swing frame, and wherein, when the bouncer seat assembly is detached from the at least one hanger arm and placed on a surface, the bouncer frame allows the seat to undergo bouncing movement relative to the surface.

2. The child swing according to claim 1, wherein the at least one hanger arm includes first and second hanger arms that swing independently relative to the swing frame.

3. The child swing according to claim 1, wherein the at least one hanger arm includes a mount, the bouncer frame is adapted to attach to and detach from the mount, and the mount is adapted to support the seat and the bouncer frame when the bouncer frame is attached to the mount.

4. The child swing according to claim 3, wherein the mount has an arcuate shape.

5. The child swing according to claim 3, wherein the mount includes at least one slot, the at least one slot is adapted to receive a portion of the bouncer frame to maintain the seat at a predetermined recline position relative to the at least one hanger arm.

6. The child swing according to claim 5, wherein the at least one slot of the at least one hanger arm comprises first, second and third slots provided on either a top surface or a side surface of the mount, and wherein the first slot corresponds to a recline position of the seat, the second slot corresponds to an upright position of the seat, and the third slot corresponds to an intermediate position between the recline position and the upright position.

7. The child swing according to claim 1, wherein the bouncer frame comprises:

a base frame that is adapted to support the seat and to allow the seat to bounce on the base frame; and at least one attachment assembly coupled to the base frame, wherein the at least one attachment assembly is adapted to couple releasably to the at least one hanger arm.

8. The child swing according to claim 7, wherein the at least one hanger arm includes a circular-shaped mount, and the at least one attachment assembly includes a circular-shaped portion.

9. The child swing according to claim 7, wherein the at least one attachment assembly comprises:

a coupling mechanism that is adapted to move between an engaged position and an disengaged position, wherein the coupling mechanism is adapted to fit into a slot provided on the at least one hanger arm, to maintain the seat at a predetermined recline position on the child swing.

10. The child swing according to claim 9, wherein the coupling mechanism is a tab.

11. The child swing according to claim 9, wherein the at least one attachment assembly further comprises:

a latch that is connected to the coupling mechanism and that allows a user to move the coupling mechanism by actuation of the latch.

12. The child swing according to claim 7, wherein the at least one hanger arm includes a mount having an arcuate surface, and the at least one attachment assembly further comprises a mount attachment housing that has an arcuate surface that slidably engages with the arcuate surface of the mount.

13. The child swing according to claim 12, wherein the mount attachment housing comprises:

a top wall;

a first sidewall; and a second sidewall, wherein the second sidewall includes a channel through which the mount of the at least one hanger arm can be inserted to couple the at least one hanger arm and the bouncer frame.

14. The child swing according to claim 7, wherein the base frame comprises:

a left side frame member; and a right side frame member, wherein the left and right side frame members curve inward towards each other at an intermediate section along their respective lengths.

15. A child swing comprising:

a swing frame;

at least one hanger arm moveably coupled to the swing frame, the at least one hanger arm including a mount having an arcuate surface;

a seat;

at least one attachment assembly associated with the seat and having a complementary arcuate surface, the at least one attachment assembly adapted to be coupled to the mount of the at least one hanger arm, wherein the arcuate surface and the complementary arcuate surface are adapted to move relative to each other to allow the seat to recline relative to the at least one hanger arm.

16. The child swing according to claim 15, wherein the seat is removable from the swing frame.

17. The child swing according to claim 15, wherein the at least one hanger arm includes first and second hanger arms that swing independently relative to the swing frame.

18. The child swing according to claim 15, further comprising:

a seat frame, wherein the seat frame includes:

a seat support frame that is adapted to hold the seat in place;

a base frame that supports the seat support frame; and the at least one attachment arm, wherein the at least one attachment assembly is adapted to couple to the mount to hold the seat and the seat frame above the ground on the child swing and to allow the seat and the seat frame to swing with movement of the at least one hanger arm.

19. The child swing according to claim 18, wherein the base frame includes a left side base frame member and a right side base frame member, and wherein the left and right side base frame members curve inward towards each other at an intermediate section along their respective lengths.

20. The child swing according to claim 15, wherein the at least one hanger arm includes at least one slot, wherein the attachment assembly further comprises a coupling mechanism that is adapted to move between an engaged position and an disengaged position, and wherein the coupling mechanism is adapted to fit into the at least one slot provided on the at least one hanger arm, to maintain the seat at a predetermined recline position on the child swing.

21. The child swing according to claim 20, wherein the mount has an arcuate surface with the at least one slot provided therein.

22. The child swing according to claim 21, wherein the at least one attachment assembly further comprises a mount attachment housing that has an arcuate surface that slidably engages with the arcuate surface of the mount.

23. The child swing according to claim 21, wherein the at least one slot of the mount comprises first, second and third slots provided on either a top surface or a side surface of the mount, and wherein the first slot corresponds to a recline position of the seat, the second slot corresponds to an upright position of the seat, and the third slot corresponds to an intermediate position between the recline position and the upright position.

* * * * *